US005534896A

United States Patent [19]

Osborne

[11] Patent Number: 5,534,896

[45] Date of Patent: Jul. 9, 1996

[54] TUBELESS INK-JET PRINTER PRIMING CAP SYSTEM AND METHOD

[75] Inventor: William S. Osborne, Vancouver, Wash.

[73] Assignee: Hewlett-Packard Company, Palo Alto, Calif.

[21] Appl. No.: 94,634

[22] Filed: Jul. 19, 1993

[51] Int. Cl.[6] ..... B41J 2/165

[52] U.S. Cl. ..... 347/29; 347/30; 347/32

[58] Field of Search ..... 346/140 R; 347/29, 347/30, 32

[56] References Cited

U.S. PATENT DOCUMENTS

| | | | |
|---|---|---|---|
| Re. 32,880 | 2/1989 | Lapeyre . | |
| 3,820,445 | 6/1974 | Klink . | |
| 3,926,211 | 12/1975 | MacLarty . | |
| 4,162,501 | 7/1979 | Mitchell et al. | 346/140 R |
| 4,272,052 | 6/1981 | Gidner . | |
| 4,372,208 | 2/1983 | Legardinier . | |
| 4,488,702 | 12/1984 | Lapeyre . | |
| 4,600,931 | 7/1986 | Terasawa | 347/30 |
| 4,785,719 | 11/1988 | Bachschmid et al. . | |
| 4,872,813 | 10/1989 | Gorton et al. . | |
| 5,051,761 | 9/1991 | Fisher et al. | 346/140 R |
| 5,055,856 | 10/1991 | Tomii et al. | 346/1.1 |
| 5,108,373 | 4/1992 | Bancsi et al. . | |
| 5,151,715 | 9/1995 | Ward et al. | 347/140 R |
| 5,153,613 | 10/1992 | Yamaguchi et al. | 347/32 |
| 5,252,993 | 10/1993 | Tomii et al. | 346/140 R |
| 5,260,724 | 11/1993 | Tomii et al. | 346/140 R |
| 5,416,507 | 5/1995 | Otsuka | 347/32 |

FOREIGN PATENT DOCUMENTS

| | | | |
|---|---|---|---|
| 0423475A1 | 4/1991 | European Pat. Off. . | |
| 450287A | 10/1991 | European Pat. Off. | B41J 2/165 |
| 0494674A1 | 7/1992 | European Pat. Off. . | |
| 0552030 | 7/1993 | European Pat. Off. | B41J 2/165 |
| 59-209876 | 11/1984 | Japan | B41J 3/04 |

*Primary Examiner*—Nancy Le
*Assistant Examiner*—Craig A. Hallacher

[57] ABSTRACT

Tubeless printhead-priming cap and system for ink-jet printers are described. The system is preferably implemented, using the existing printer carriage drive motor, by the use of a printhead-sealing cap having a rolling diaphragm in a lower region thereof that defines a chamber within the priming cap, with the diaphragm being reciprocated, by a spring-returned lever having a piston on one end thereof, in synchronism with lateral and differential vertical movement of a cap-carrying sled. Priming is performed uni-directionally to avoid reverse priming of the printhead. The chamber may be emptied by reversing the operation of the priming cap to pump accumulated ink into a blotter by positioning the priming cap against an ink blotter provided in a rotatable member defining a multi-service station.

14 Claims, 9 Drawing Sheets

TUBELESS INK-JET PRINTER PRIMING CAP SYSTEM AND METHOD

TECHNICAL FIELD

The present invention relates generally to priming ink-jet printer printheads. More particularly, the invention concerns a tubeless system that includes a priming cap having integrally formed therewith a pump diaphragm automatically actuated by printhead carriage movement to draw ink droplets from a sealed printhead into a chamber formed between the cap's upper and lower expanses.

BACKGROUND ART

Rolling diaphragm assemblies are known to have been used in flow control metering valves in automotive applications, e.g. internal combustion engines, while printing applications that utilize diaphragms conventionally have used disk-shaped diaphragms and valves to pump small quantities of ink from reservoirs to printers via flexible tubes and conduits. Recent advances in ink-jet printhead priming and flushing are described in my co-pending U.S. patent application Ser. No. 07/949,318, filed Sep. 21, 1992 entitled "Automatic Failure Recovery Method and System for Ink-jet Printheads", which is subject to common ownership herewith. The system described therein requires a vacuum-and-flush tube, a rotating cam, and a tube pinch-off follower member per printhead, as well as a common diaphragm-type pump, drive motor clutch mechanism and firmware for synchronously controlling a drive motor's forward and reverse rotation. The system is effective in priming and flushing ink from plural printheads, thus to avoid clogging of the printheads' nozzles, but it involves many moving parts and their attendant cost of production and maintenance and it is subject to accumulation of ink and particulate in the tubes. The system also requires a relatively long, e.g. twenty second or more, cycle time during which the ink-jet printer is out of service.

DISCLOSURE OF THE INVENTION

The invented system requires fewer parts, involves lower cost and achieves higher reliability than previous ink-jet printhead-priming systems. It is preferably implemented, using the existing printer carriage drive motor, by integrally molding a rolling diaphragm into a lower region of a printhead-sealing cap, with the diaphragm being reciprocated by a spring-returned lever in synchronism with lateral and differential vertical movement of a cap-carrying sled, wherein priming is accomplished uni-directionally to avoid reverse priming of the printhead. There are no tubes subject to becoming clogged with ink or other particulate. Out-of-service printhead-priming cycle time is reduced to under five seconds, thus increasing long-term printer throughput. The invented system may be integrated with printhead capping systems, as in a rotatable, multi-service station equipped with an ink blotter.

These and additional objects and advantages of the present invention will be more readily understood after a consideration of the drawings and the detailed description of the preferred embodiment.

DETAILED DESCRIPTION OF THE PREFERRED EMBODIMENTS AND BEST MODE OF CARRYING OUT THE INVENTION

Figure 1:
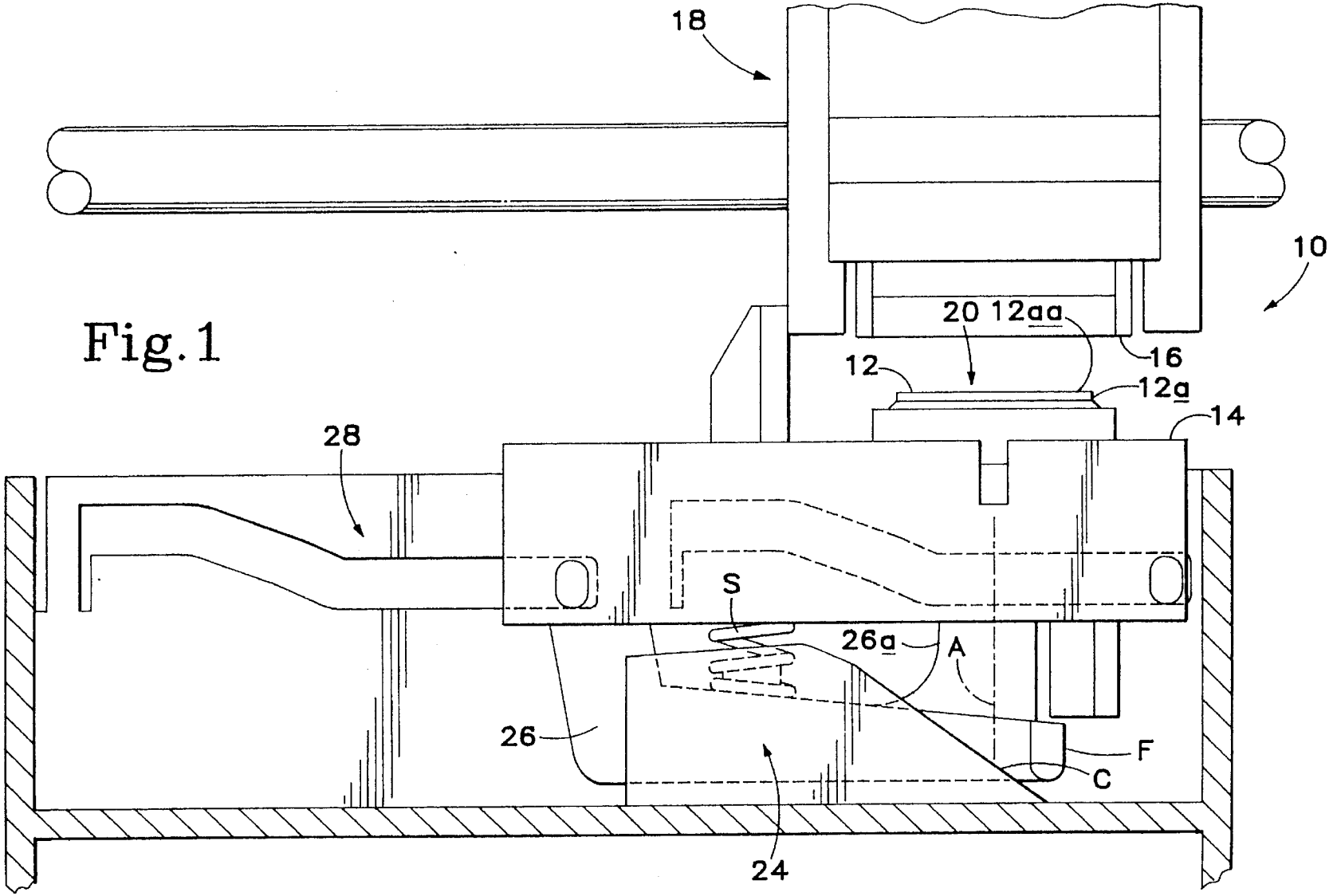
FIG. 1 is a front elevation of the invented priming cap and system made in accordance with their preferred embodiments.

FIG. 1 is a front elevation of the invented priming system in its preferred embodiment, indicated at 10. In a first preferred embodiment, system 10 includes an ink-jet printhead-priming cap 12 mounted for vertical reciprocation on a sled 14 beneath an ink-jet printhead 16 that typically is mounted for horizontal reciprocation on a carriage including a carriage rod, indicated generally at 18.

Figure 2:
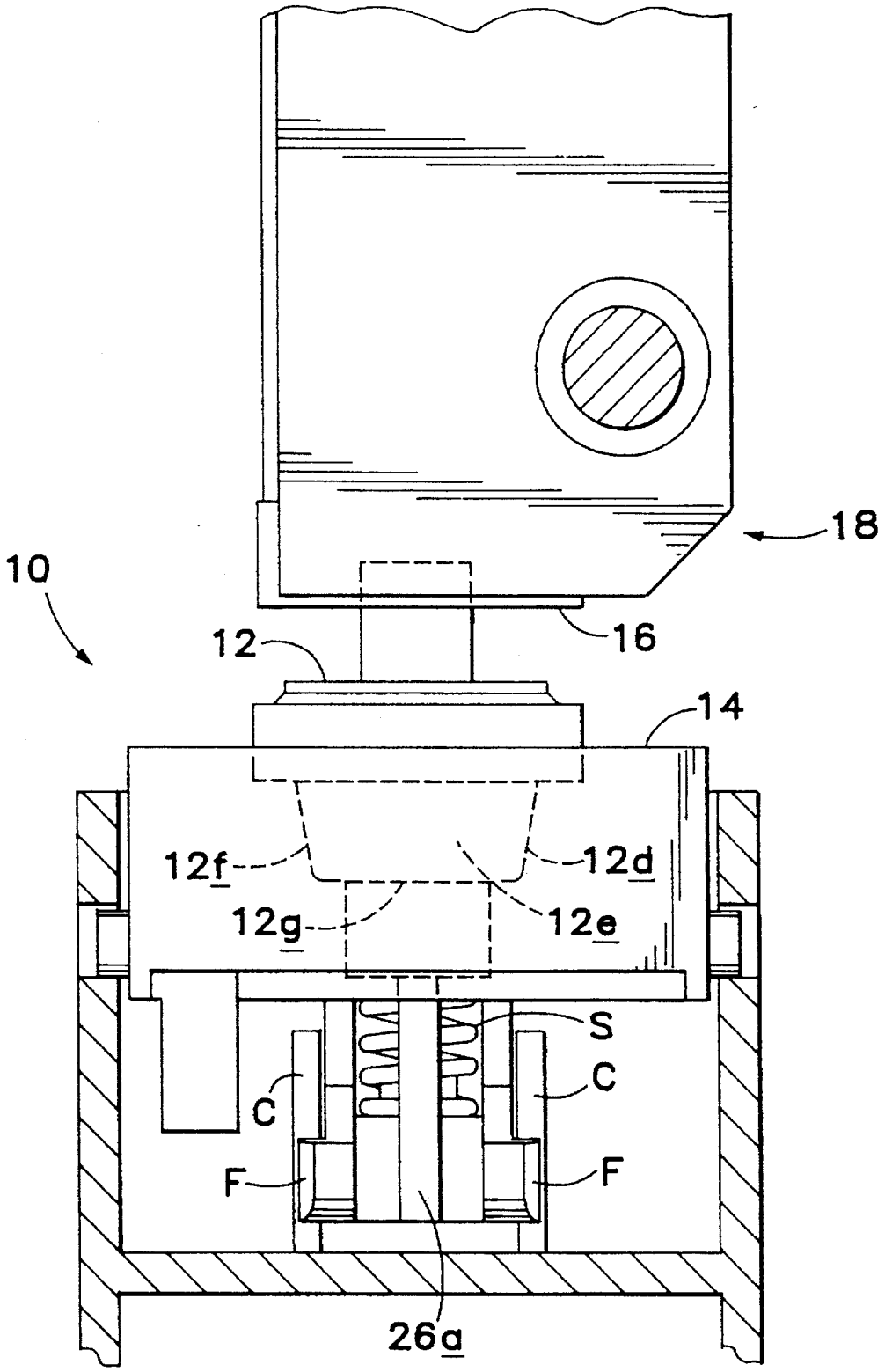
FIG. 2 is a side elevation of the cap and system corresponding generally with FIG. 1, but showing the system in a different phase of its operation.
Figure 3A:
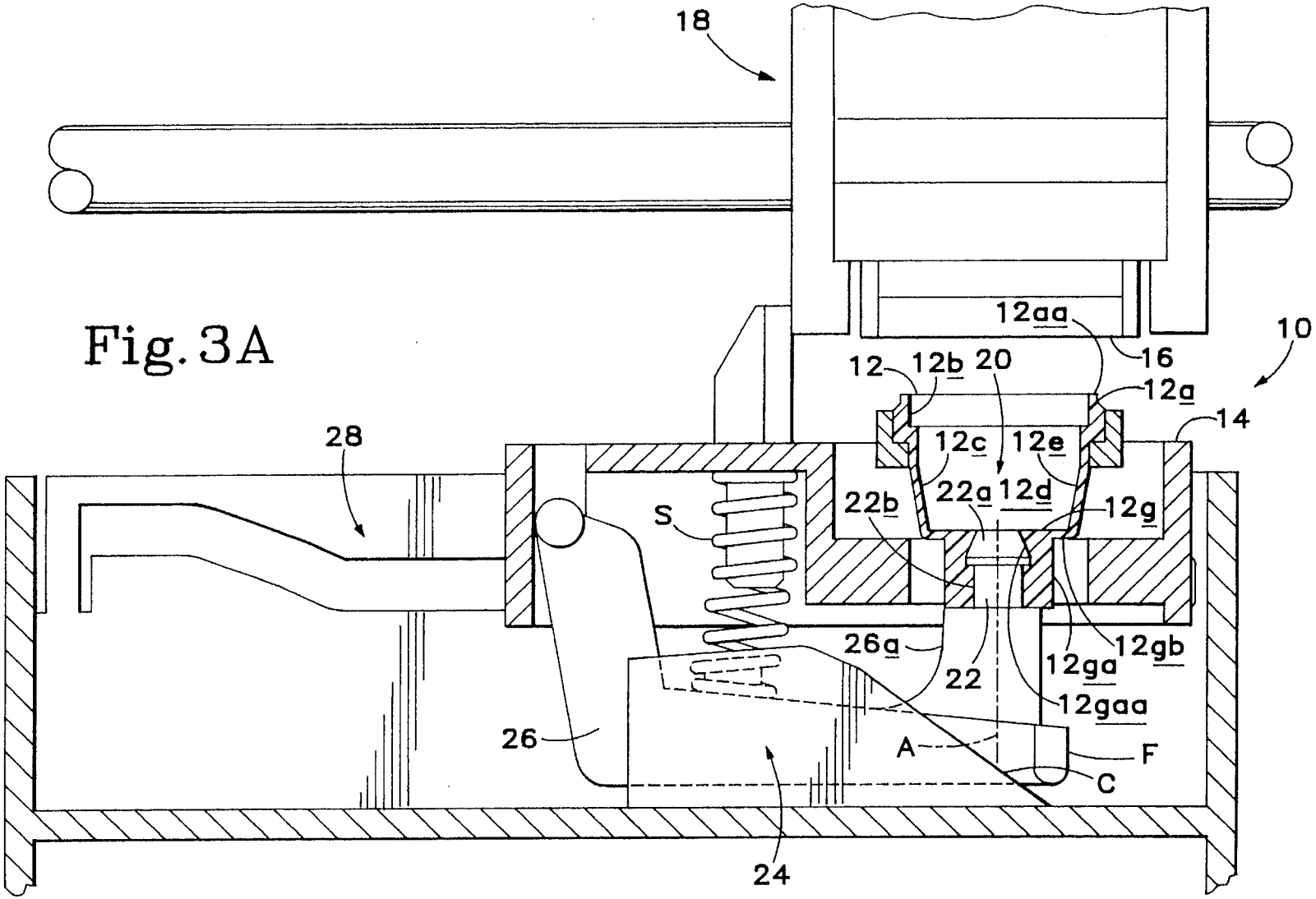
FIGS. 3A through 3F are sectional illustrations corresponding generally with FIG. 1 and showing various phases of the operation of the invented priming cap and system.

Referring collectively to FIGS. 1, 2 and 3A, cap 12 preferably includes an upper peripheral lip (hereinafter, referred to as a first, e.g. upper, expanse 12*a* including a peripheral lip region 12*aa*) for sealingly engaging an ink-jet printhead, with first expanse 12*a* also preferably having formed therein an aperture 12*b* through which ink can be drawn. Cap 12 also preferably includes flexible sidewalls such as rectilinearly extending sidewalls 12*c*, 12*d*, 12*e*, 12*f* connected in a first, e.g. upper, region thereof with, and extending from, first expanse 12*a*, with the sidewalls extending at least substantially continuously around a perimeter of the first expanse, as shown in FIG. 1. Cap 12 also preferably includes a lower portion of cap 12 (hereinafter, referred to as second, e.g. lower, expanse 12*g*) connected with a second, e.g. lower, region of sidewalls 12*c*, 12*d*, 12*e*, 12*f* to form a substantially sealed chamber of nominal volume into which ink can be drawn, such chamber being indicated in FIG. 1 generally at 20.

Preferably, second expanse 12*g* has generally centrally located therein structure, e.g. a thickened central region 12*ga* having a hole 12*gaa* formed therein, for matingly, e.g. yieldably conformingly, engaging a piston, or piston member, 22. Those of skill will appreciate that, within the spirit and scope of the invention, alternative means for engaging piston 22 and first expanse 12*a* of cap 12 may be used. Those skilled in the art also will appreciate that flexible sidewalls 12*c*, 12*d*, 12*e*, 12*f* enable the volume of chamber 20 alternately to be decreased and increased by piston action, thereby to prime printhead 16 by producing relatively reduced pressure in the chamber to draw ink thereinto from the printhead with the printhead sealingly engaged by lip region 12*aa* of first expanse 12*a*. Thus, flexible sidewalls 12*c*, 12*d*, 12*e*, 12*f* collectively will be referred to herein as a diaphragm, and more specifically in the context of the preferred embodiment of the invention as a rolling diaphragm, for reasons that will be apparent to persons skilled in the art.

First and second expanses 12*a*, 12*g*, as well as flexible sidewalls 12*c*, 12*d*, 12*e*, 12*f*, preferably are integrally molded from any suitable material, e.g. a pliable polymeric or other elastomeric material. As may be seen from FIG. 1, central region 12*ga* of second expanse 12*g* is generally congruent with the piston member-mating structure described above is thicker than a peripheral, or annular, region 12*gb* therearound. As also may be seen from FIG. 1, the thickness of the second region of sidewalls 12*c*, 12*d*, 12*e*, 12*f* preferably is substantially the same as the thickness of second expanse 12*g* in such peripheral region 12*gb*, and the inner surfaces of the sidewalls preferably continuously smoothly connect with this peripheral region of the second expanse. In order to make second expanse 12*g* and sidewalls 12*c*, 12*d*, 12*e*, 12*f* of cap 12 form what is referred to herein as a rolling diaphragm, one of the first and second expanses is of lesser extent in its two dimensions than the other in its two corresponding dimensions such that connecting sidewalls 12*c*, 12*d*, 12*e*, 12*f*, are inclined therebetween.

It will be understood that, in operation, sidewalls 12*c*, 12*d*, 12*e*, 12*f* "roll" and "unroll" smoothly in response to reciprocal movement of second expanse 12*g*, such as that produced by piston member 22, generally along a reciprocation axis A. Preferably, a region of second expanse 12*g* around the inside of hole 12*gaa* formed therein that forms the above-described piston member-mating structure includes a recessed annular shoulder for seating an enlarged terminal region 22*a* of a terminal end 22*b* of piston 22 that extends at least partway through hole 12*gaa*.

Referring still to FIG. 1, invented tubeless ink-jet carriage-mounted printhead priming system 10 may be described as including 1) piston member 22 having distal end 22*b*; 2) a first drive mechanism, indicated generally at 24, for reciprocating distal end 22*b* of piston member 22 generally along a predefined axis such as axis A; and 3) a generally vertically reciprocable cap 12, cap 12 having an upper region 12*a*, preferably including lip region 12*aa*, located along axis A for sealingly engaging printhead 16 in a first predefined position of cap 12 relative to a horizontally reciprocal carriage 18 that mounts such printhead 16 (e.g. a position such as that shown in FIG. 1). Preferably cap 12 has a receptacle, also generally indicated at 20, formed therewith for receiving ink droplets introduced thereinto from the printhead.

Referring collectively to FIGS. 1 and 2, first drive mechanism 24 in accordance with the first preferred embodiment of the invention takes the form of a pivotal member, or lever, or rocker arm, 26 having operatively connected on a distal end 26*a* thereof piston member 22, with a pinned second end defining an axis for pivotal reciprocation of arm 26 thereabout by any suitable drive mechanism (such as a lifter, which in a first preferred embodiment takes the form of a cam C and a cam follower F arrangement of a cap-mounting sled and a sled mounting base, and a return spring S) to produce generally vertical reciprocation of piston member 22 in synchronization with horizontal reciprocation of the printer's carriage. Those of skill in the art will appreciate that, within the spirit and scope of the invention, any suitable means for producing reciprocation of piston member 22 may be used.

As is suggested by FIG. 1, receptacle 20 preferably has a diaphragm located along axis A defining a lower region of the receptacle, with the diaphragm having on a lower surface thereof structure operatively engaging piston member 22. The diaphragm is flexed by generally vertical reciprocation of piston member 22 in predefined synchronization with carriage 18, with cap 12 in sealing engagement with the printhead to prime the same, thereby to cause ink droplets to exit the printhead and to be collected in the receptacle.

Preferably, a second drive mechanism indicated generally at 28, is provided for lowering cap 12 to a second predefined position below the first predefined position in predefined synchronization with reciprocation of piston member 22 such that cap 12 sealingly engages printhead 16 only during a downstroke of the piston member. Preferably, operatively coupled with second drive mechanism 28 is moveable sled 14 mounting invented cap 12, wherein sled 14 is vertically reciprocated in predetermined synchronism with lateral reciprocation of carriage 18. In this embodiment of invented system 10, lowering of sled 14 effects lowering of cap 12 to such second predefined position.

It will be appreciated that second drive mechanism in the first preferred embodiment described and illustrated herein may take the form of the cam and cam follower arrangement suggested in FIGS. 1 and 3A through 3F constructed, for example, in accordance with the teachings of my co-pending U.S. patent application Ser. No. 07/949,197 entitled "Ink-jet Printhead Capping and Wiping Method and Apparatus", which was filed Sep. 21, 1992 and which is commonly owned herewith. Alternatively, second drive mechanism 28 may take the form of a stepper motor capable of alternately raising and lowering sled 14 responsive to drive signals produced by the printer's controller. Those skilled in the art will appreciate that sled 14 may be reciprocally raised and lowered by any suitable means.

FIG. 2 corresponds with FIG. 1, but represents invented system 10 in side elevational view. Clearly from comparing FIGS. 1, 2 and 3C, chamber or receptacle 20 is reduced from a maximum to a minimum volume, and sidewalls 12*c*, 12*d*, 12*e*, 12*f* are rolled, or substantially and smoothly folded back on themselves, such that the sealing engagement of lip region 12*aa* of expanse 12*a* with printhead 16 during a downstroke of piston 22 produces a vacuum within chamber 20. Those of skill will appreciate that, as piston 22 returns from its position shown in FIG. 3C, for example, to its position shown in FIG. 1, the one or more pens of ink-jet printhead 16 will be primed, and ink droplets will be forced to exit the pens' orifices, to pass through hole 12*b* in expanse 12*a* and to drop into chamber or receptacle 20. In this way, then, ink-jet printhead 16 is primed without the need for a tube for each included pen leading from a corresponding priming structure to a common receptacle located remote therefrom, as heretofore have been required.

Figure 3B:
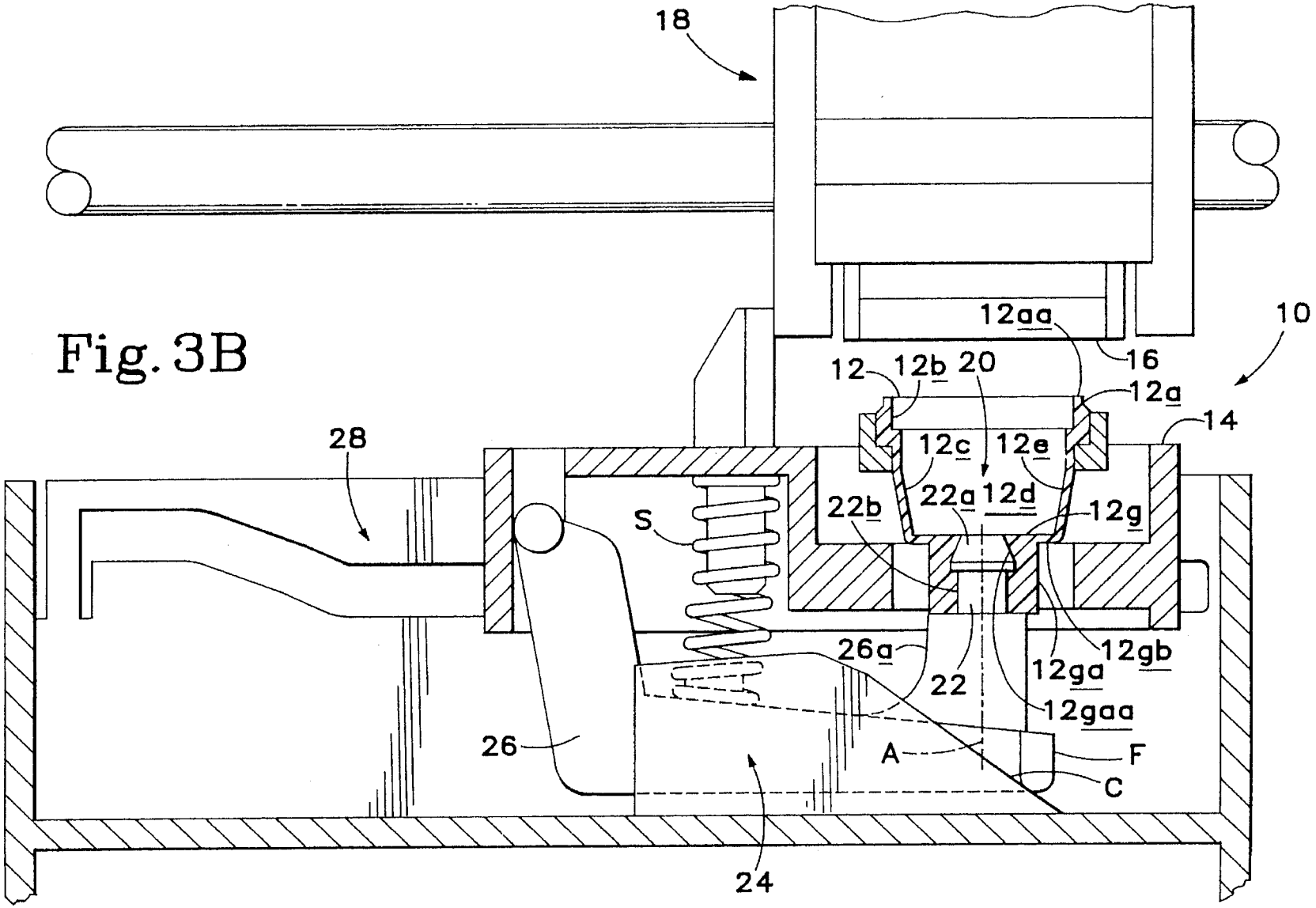
Figure 3C:
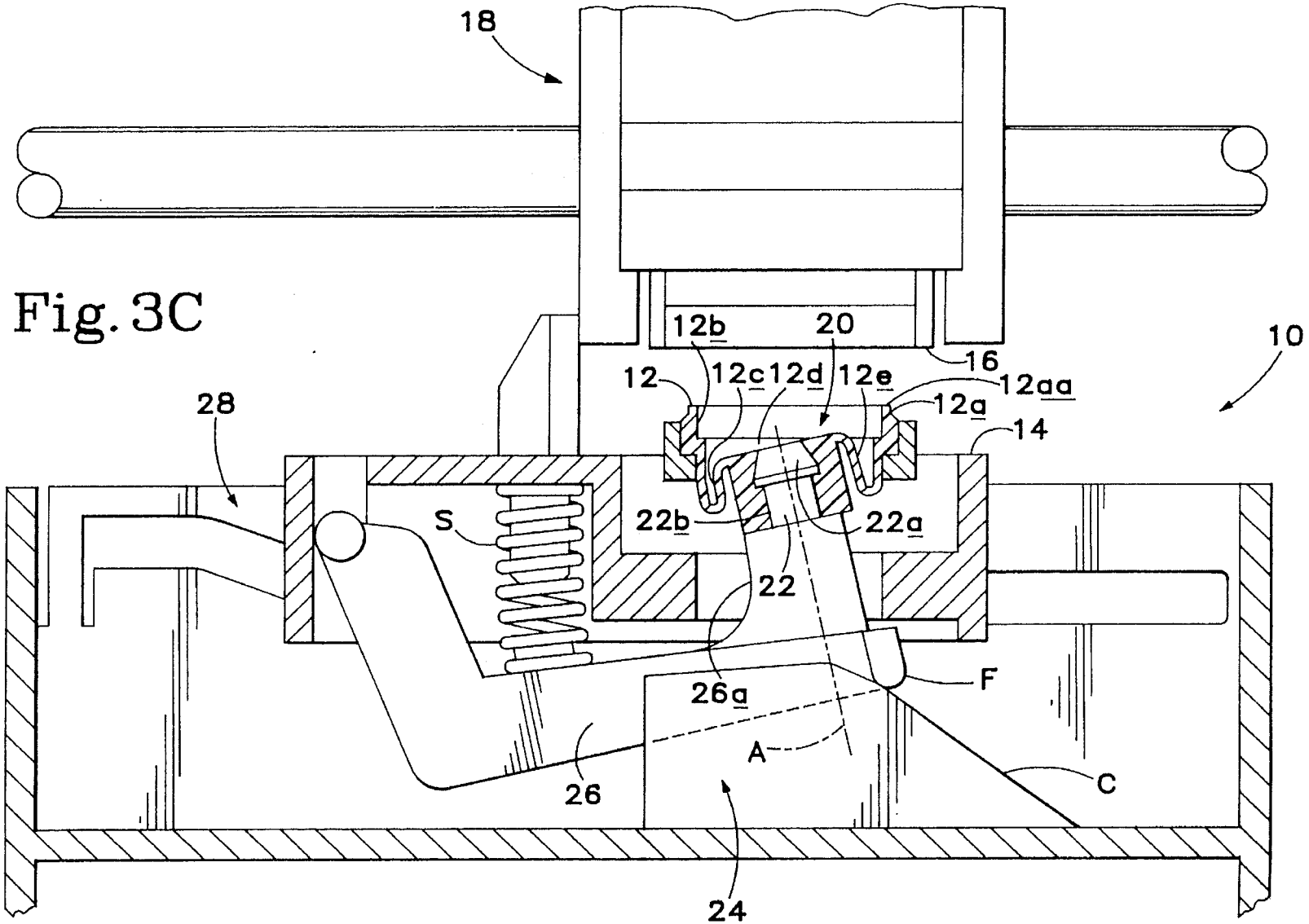
Figure 3D:
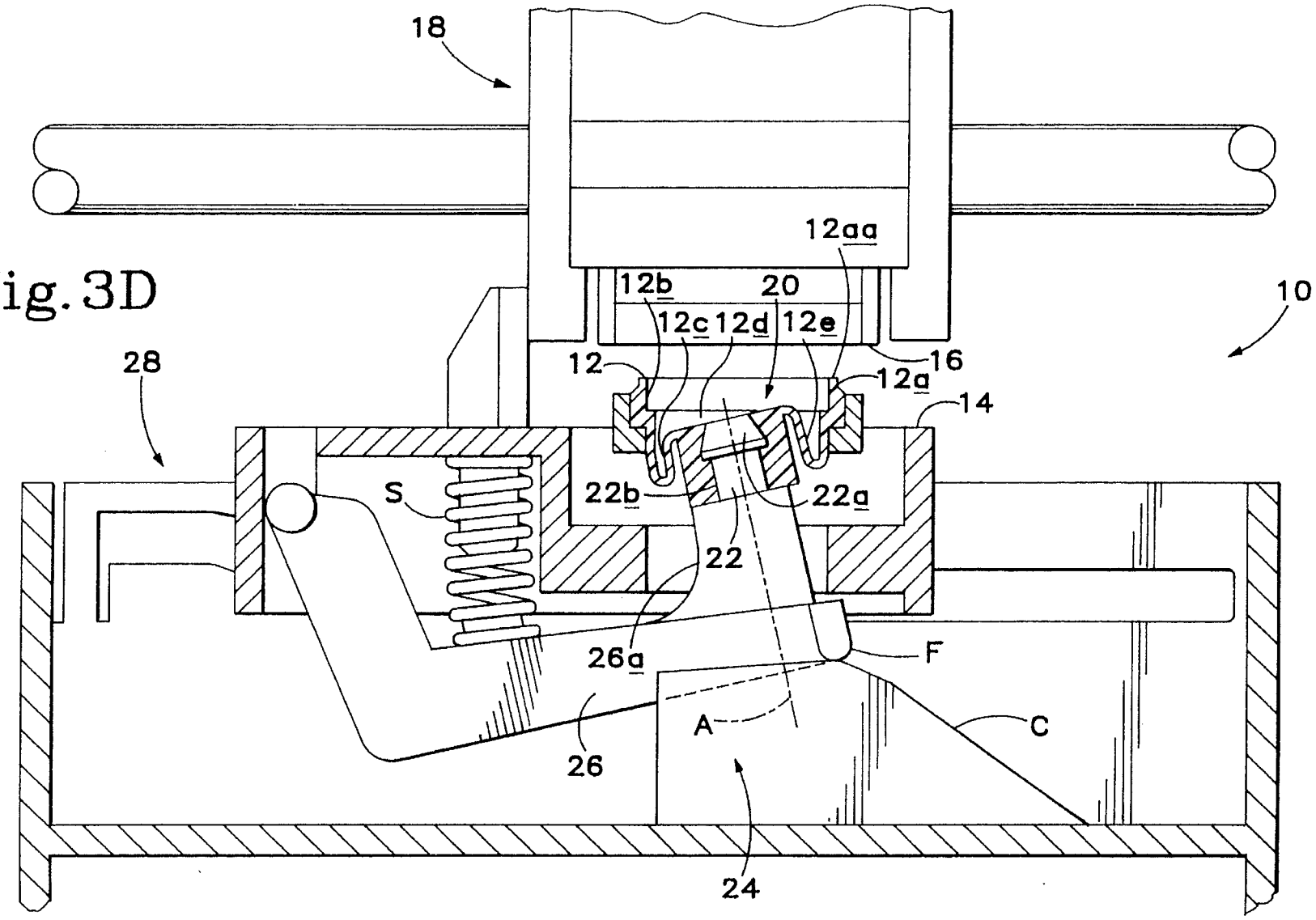
Figure 3E:
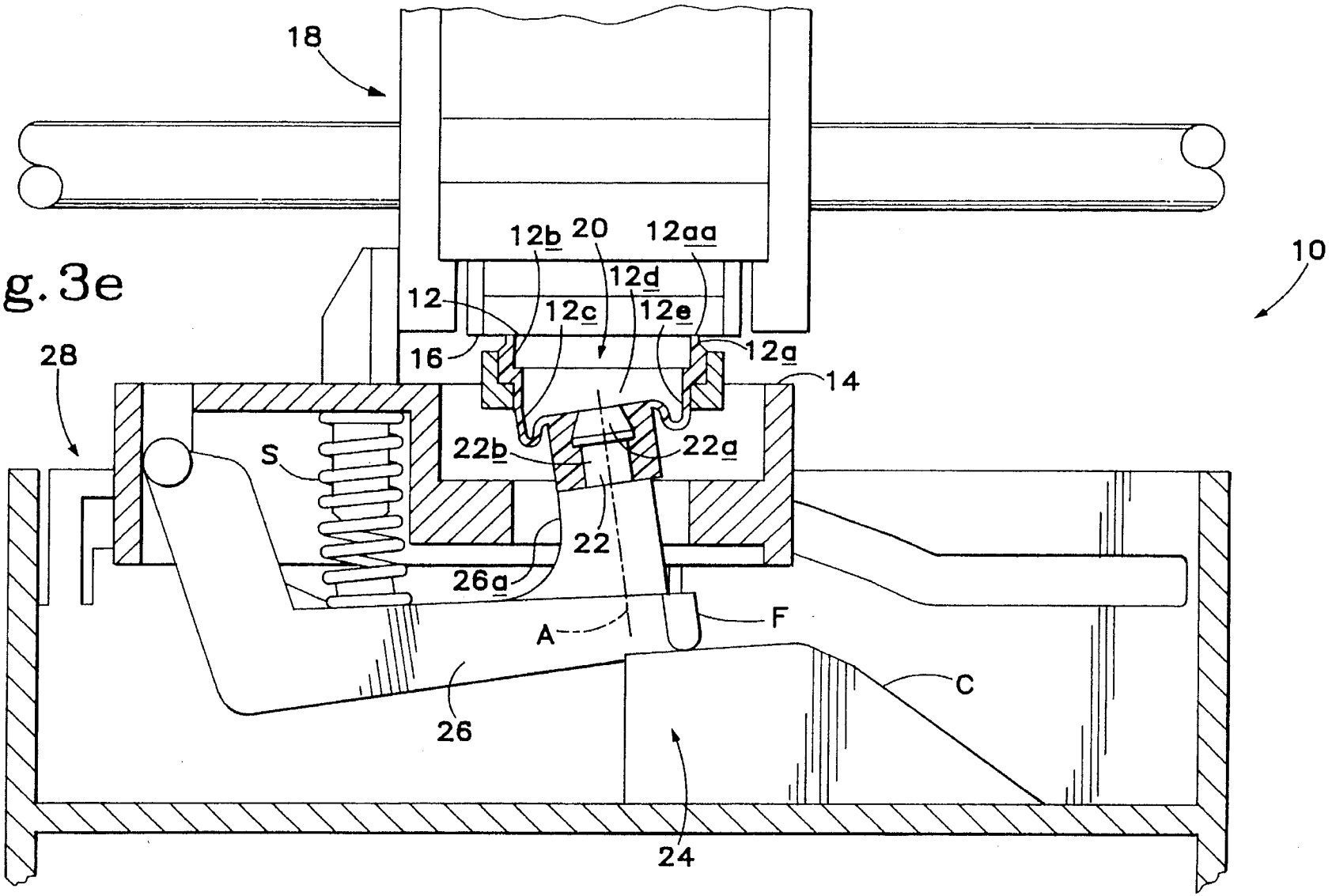

FIGS. 3A through 3F illustrate the operation of system 10 in various phases of its operation, in somewhat simplified form. FIG. 3A shows system 10 in an initial, or start, phase of operation in which sled 14 is lowered and invented priming cap 12 is uncompressed such that its chamber is of maximum volume. FIG. 3B shows system 10 in a later phase of operation in which sled 14 remains in its lowered position and in which compression of cap 12 begins. FIG. 3C shows system 10 in a still later phase of operation in which sled 14 yet is lowered (and has been moved to the left by carriage 18, and the second end 26*h* of lever 26 has climbed the sled's ramped cam surface) and in which cap 12 is fully compressed such that its chamber is of minimal volume. FIG. 3D shows system 10 in a yet later phase of operation in which capping begins by raising sled 14 with cap 12 yet fully compressed but without contact between its lip region 12*aa* and printhead 16. FIG. 3E shows system 10 in a priming phase of operation in which previously fully compressed cap 12 sealingly engages printhead 16 and during which ink is drawn from ink-jet printhead 16 by progressive decompression of the cap. It is noted that lever 26 controllably is returning piston 22 to its initial, unelevated position by the cooperative action of spring S, cam C and follower F.

Those skilled in the art will appreciate that, as described herein "capping" refers to the sealing engagement with printhead 16 of lip region 12*aa* of cap 12, rather than to conventional capping of a printhead when it is not in use, which conventional capping requires printhead venting to ambient pressure. As will be seen by later reference to FIG. 4, invented priming cap and system are compatible with such conventional capping of printheads for such purpose, while also providing the unique printhead-priming advantages described herein.

Figure 3F:
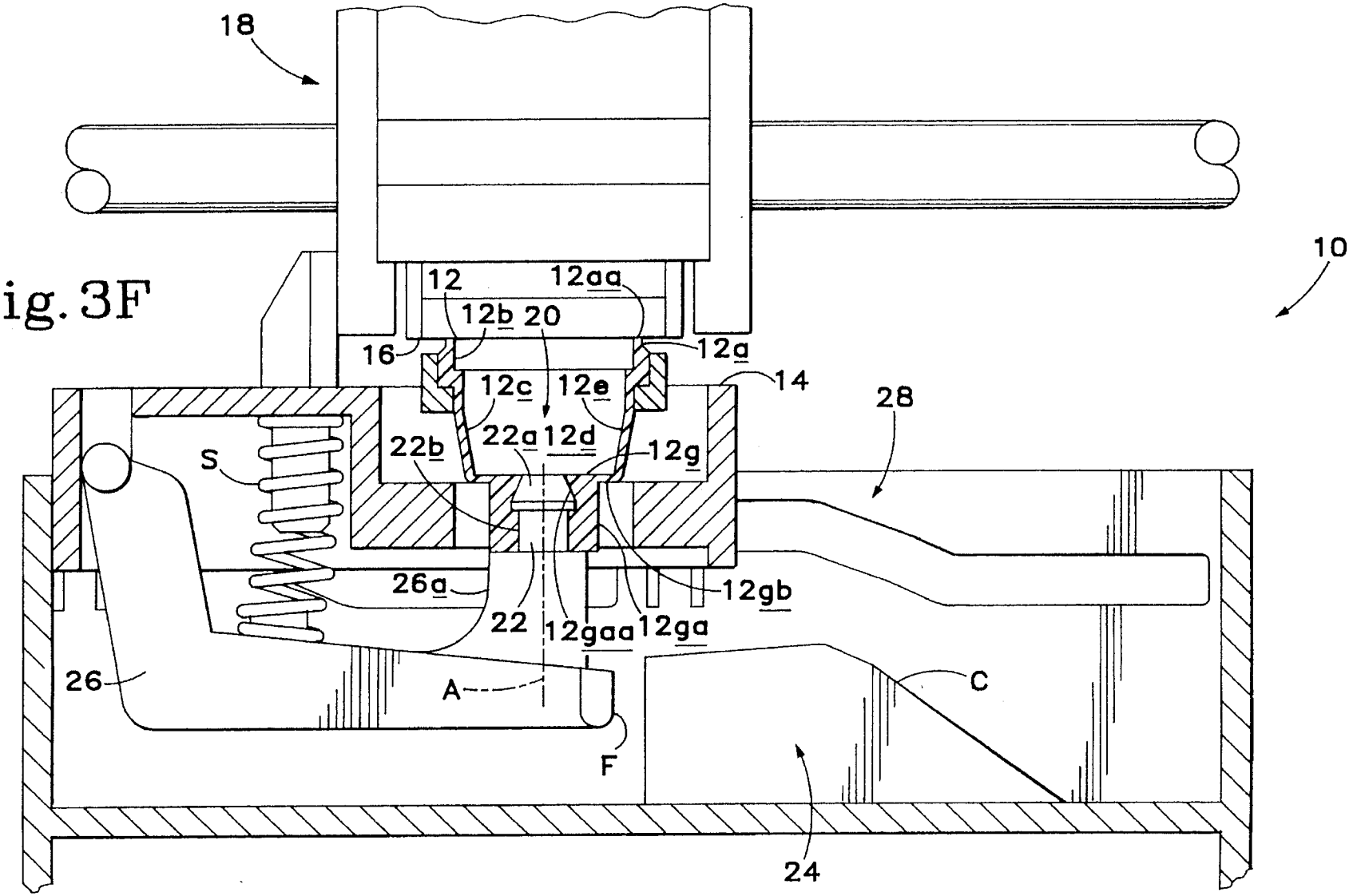

Finally, FIG. 3F shows system 10 in a final phase of operation in which priming by cap 12 is complete. It is noted that lever 26 has returned fully to its initial position, representing completion of a downstroke of first end 22*a* of operatively connected piston member 22 and decompression of cap 12. Importantly, it will be appreciated by contrasting FIGS. 3D, 3E and 3F that printhead 16 is not capped during an upstroke of piston member 22 during which cap 12 is compressed, but instead is capped preferably simultaneously with, or slightly after, the beginning of the downstroke of piston member 22. In this way, no head is produced in printhead 16 and only a vacuum is produced therein at the beginning of the priming step facilitated by invented priming cap 12 and system 10 described herein. This avoids undesirable production of a positive pressurization of printhead 16 that might damage the printhead.

Figure 4:
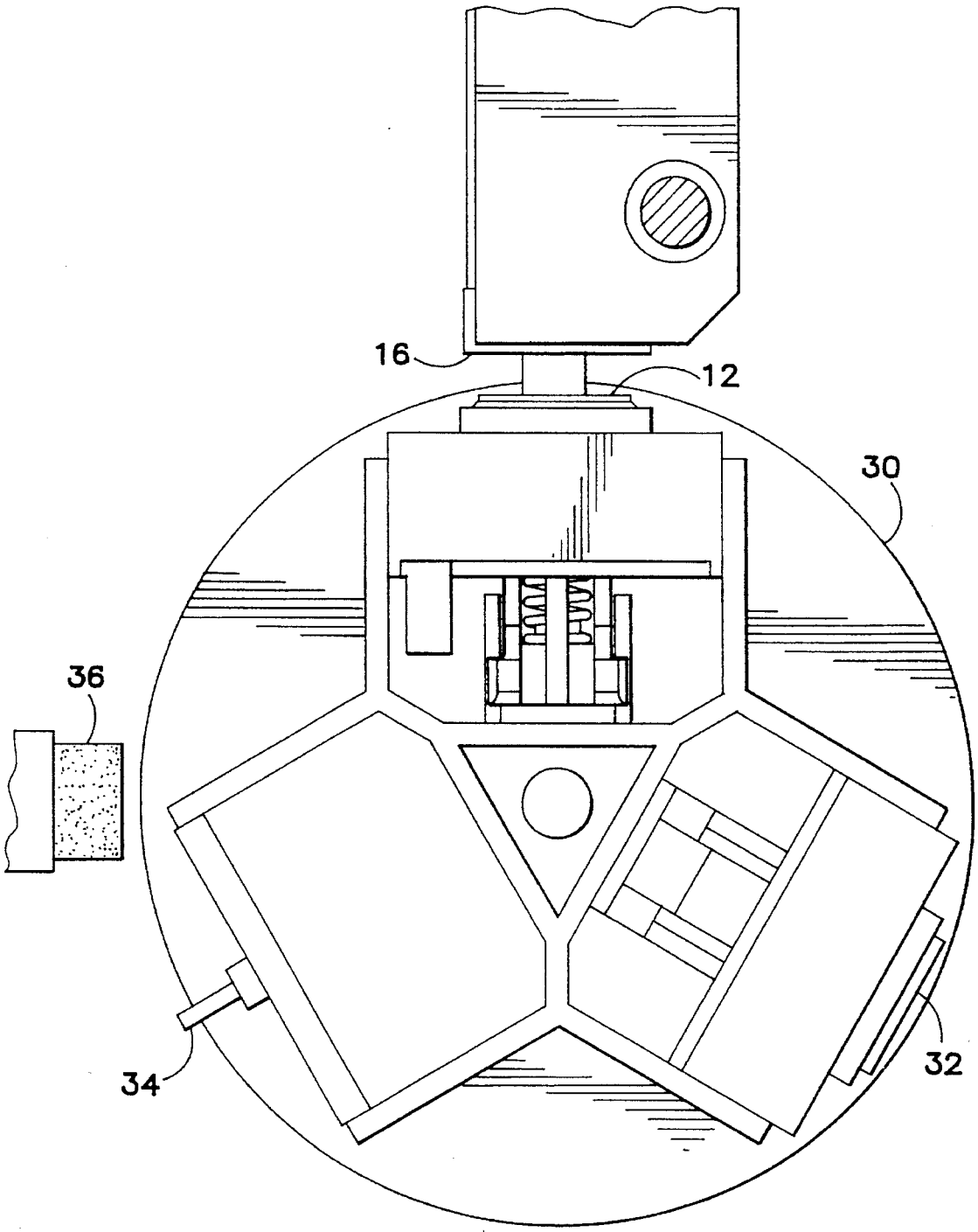
FIG. 4 is an alternative embodiment of the invention featuring a dual printhead capping and priming system in a rotatable, multi-service station.

FIG. 4 illustrates an alternative embodiment of invented system 10 in which a priming cap is mounted for rotation on a multi-service station including an ink blotter for removing accumulated ink therefrom. In this also preferred embodiment of invented system 10, a rotatable member 30 mounts cap 12 for selective sealing engagement of printhead 16 thereby when member 30 is rotated to a first predefined position of proximity between cap 12 and printhead 16 (e.g. the position shown in FIG. 4). Other service stations, including, for example, a conventional cap 32 and a conventional wiper 34, may be provided on member 30. Shown also in FIG. 4 is a blotter 36 disposed adjacent the periphery of rotatable member 30 in arcuately spaced relationship with printhead 16 for blotting ink collected in receptacle 20 when rotatable member 30 is rotated to a predefined second position of proximity between cap 12 and such blotter 36. It will be appreciated that this second predefined position corresponds to the location of blotter 36 shown in FIG. 4, and that rotatable member 30 may of course be rotated, either unidirectionally or bidirectionally, by any suitable means such as a stepper motor under the control of the ink-jet printer's controller. Preferably, although the capacity of invented priming cap 12 is 500–1000 typical priming cycles, it is convenient to blot priming cap 12 after each priming cycle, as by use of blotter 36 of the alternative FIG. 4 embodiment.

Other services may of course be performed by rotatable member 30 by equipping it with various service positions, e.g. it also may provide for wiping, spitting, capping and/or other desirable servicing of printhead 16. Skilled persons will appreciate that, by providing for any needed venting of the printhead during capping thereof for prolonged printer non-use, it may be possible at lower cost to integrate the priming and capping structures within one service station position. In other words, priming cap 12 may be designed at somewhat greater complexity to provide a vacuum seal with printhead during the relatively short-term priming cycle, as taught herein, and to provide a vent to ambient of the printhead during the relatively long-term capping cycle, as is known.

INDUSTRIAL APPLICABILITY

It now may be appreciated that the invented priming cap and system eliminate the need for tubes extending between a common diaphragm pump and one or more primer mechanisms corresponding with one or more printheads, and between such one or more primer mechanisms and a common ink receptacle. In accordance with the invention, ink-jet printhead priming is accomplished for one or more printheads without tubes and without a multiplicity of complex priming assemblies for the one or more printheads. The invented priming cap and system are relatively easily and inexpensively manufactured and maintained in singular or plural ink-jet printhead printers, with the simplest of drive mechanisms including, for example, a cam and cam follower arrangement of a sled driven by the printer's existing carriage motor, a lever and a spring. The cap itself inexpensively may be manufactured by the use of relatively inexpensive tools such as injection molds. In operation, the priming of one or more printheads is accomplished in a short cycle time, thus taking the printer off-line for priming only minimally.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. A tubeless ink-jet carriage-mounted printhead priming system comprising:

a piston member having a distal end;

a first drive mechanism for reciprocating said distal end of said piston member generally along a predefined axis;

a generally vertically reciprocable cap, said cap having an upper region located along said axis for sealingly engaging a printhead in a first predefined position of said cap relative to a horizontally reciprocal carriage that mounts the printhead, said cap having a receptacle formed therewithin for receiving ink droplets introduced thereunto from the printhead; and a second drive mechanism for lowering said cap to a second predefined position below said first predefined position in predefined synchronization with reciprocation of said piston member such that said cap sealingly engages the printhead only during a downstroke of said piston member, such that said distal end of said piston member moves away from the printhead during the downstroke of said piston member, said receptacle having a flexible diaphragm located along said axis and defining a lower region of said receptacle, said diaphragm having on a lower surface thereof structure operatively engaging said distal end of said piston member, said diaphragm being flexed by generally vertical reciprocation of said distal end of said piston member in predefined synchronization with horizontal reciprocation of the printhead on the carriage with said cap in sealing engagement with the printhead to prime the printhead thereby to cause ink droplets to exit the printhead and to be collected in said receptacle.

2. The system of claim 1 which further comprises a moveable sled operatively coupled with said second drive mechanism and mounting said cap, wherein lowering of said sled effects such lowering of said cap.

3. The system of claim 1 which further comprises a rotatable member mounting said cap for selective sealing: engagement of the printhead thereby when said rotatable member is rotated to a first predefined position of proximity between said cap and such printhead.

4. The system of claim 3 which further comprises a blotter disposed adjacent the periphery of said rotatable member in arcuately spaced relationship with such printhead for blotting of ink collected in said receptacle when said rotatable member is rotated to a predefined second position of proximity between said cap and such blotter.

5. The system of claim 1, wherein said cap includes an upper peripheral lip for sealingly engaging the printhead thereby to cap the printhead, said lip having formed therein an aperture through which ink can be drawn, wherein said cap further includes flexible sidewalls connected with and extending downwardly from said lip, said sidewalls extending continuously around a perimeter of said lip and wherein said cap further includes a lower portion connected with a lower extent of said sidewalls to form a substantially sealed chamber of nominal volume into which ink can be drawn, said lower portion having generally centrally located in a bottom surface thereof structure for matingly engaging said piston member, said flexible sidewalls enabling the volume of said chamber alternately to be decreased and increased by piston action, thereby to prime the printhead by producing relatively reduced pressure in said chamber to draw ink thereunto from the printhead with the printhead sealingly engaged by said lip.

6. The system of claim 5, wherein said lip, said lower portion, and said sidewalls of said cap are integrally molded from a pliable polymeric material.

7. The system of claim 6, wherein a central region of said lower portion generally congruent with said structure is thicker than a peripheral region therearound.

8. The system of claim 7, wherein said lower extent of said sidewalls has a thickness;

said lower portion in said peripheral region has a thickness;

the thickness of said lower extent of said sidewalls is substantially equivalent to the thickness of said lower portion in said peripheral region; and the inner surfaces of said sidewalls continuously smoothly connect with said peripheral region of said lower portion.

9. The system of claim 8, wherein said lower portion is of lesser extent in two dimensional area than that of said lip and wherein said sidewalls are inclined therebetween to form a rolling diaphragm.

10. The system of claim 9, wherein said structure of said lower portion includes a hole formed therein with a region around an inside of the hole including a recessed annular shoulder for seating an enlarged terminal region of said piston member that extends at least partway through said hole.

11. A tubeless ink-jet carriage-mounted printhead priming system comprising:

a piston member having a distal end;

a first drive mechanism for reciprocating said distal end of said piston member generally along a predefined axis;

a generally vertically reciprocable cap, said cap having an upper peripheral lip located along said axis for sealingly engaging a printhead in a first predefined position of said cap relative to a horizontally reciprocable carriage that mounts the printhead, said lip having formed therein an aperture through which ink can be drawn, said cap including a receptacle for receiving ink droplets introduced thereunto from the printhead, said receptacle having a rolling diaphragm located along said axis and defining a lower region of said receptacle, when upper peripheral lip is sealing engaged with printhead, said receptacle having nominal volume into which ink can be drawn, said diaphragm having on a lower surface thereof structure operatively engaging said distal end of said piston member and said diaphragm being integrally molded from a flexible polymeric material and being flexed by generally vertical reciprocation of said distal end of said piston member in predefined synchronization with horizontal reciprocation of the printhead on the carriage with said cap in sealing engagement with the printhead, so that the printhead is primed by flexing said diaphragm to increase the volume of the receptacle to a volume greater than the nominal volume, thereby drawing droplets thereunto from the printhead while the printhead is sealingly engaged by said lip; and a second drive mechanism for lowering said cap to a second predefined position below said first predefined position in predefined synchronization with reciprocation of said piston member such that said cap sealingly engages the printhead only during a downstroke of said piston member.

12. The system of claim 2, wherein the first drive mechanism comprises:

a pivotal arm with a first end connected to said distal end of said piston member and a second end pinned to said sled, said second end defining an axis for pivotal reciprocation of said arm thereabouts; and a lifter to produce generally vertical reciprocation of said distal end of said piston member in predefined synchronization with horizontal reciprocation of the printhead on the carriage, wherein said lifter comprises:

a sloped cam mounted onto a printer's chassis;

a cam follower protruding from said arm's first end and configured to ride said sloped cam, thereby producing pivotal reciprocation of said arm about said second end of said arm; and a spring between said sled and said arm, thereby biasing said arm away from said sled.

13. The system of claim 2, wherein said first and said second drive mechanisms effect generally vertical reciprocation of both said cap and said sled in predefined synchronization with horizontal reciprocation of the printhead on the carriage.

14. A method for priming a tubeless ink-jet carriage-mounted printhead using a horizontally reciprocal carriage and a generally vertically reciprocal cap, wherein said cap includes an upper peripheral lip for sealingly engaging said printhead, flexible sidewalls, and a receptacle formed therewithin for receiving ink droplets introduced thereunto from said printhead, said receptacle having a volume, the method comprising:

positioning said cap below said printhead;

moving said printhead horizontally on said carriage, thereby rolling said cap's flexible sidewalls without said cap contacting said printhead;

reducing said volume of said receptacle;

continuing horizontally moving said printhead, thereby raising said cap toward said printhead;

sealingly engaging said cap's lip about said printhead;

further continuing horizontally moving said printhead such that said cap lowers away from said printhead and said cap's flexible sidewalls unroll;

maintaining sealing engagement of said cap's lip about said printhead; and increasing said volume of said receptacle, thereby priming said printhead by relatively reducing pressure within said chamber and drawing ink thereunto from said printhead.

* * * * *